US005347960A

United States Patent [19]

Tokumi

[11] Patent Number: 5,347,960

[45] Date of Patent: Sep. 20, 1994

[54] DOUBLE-ACTING PISTON ENGINE

[76] Inventor: Jyoji Tokumi, 3-3 2-chome, Hachiman, Kawashima-cho, Hiki-gun, Saitama, Japan

[21] Appl. No.: 100,089

[22] Filed: Jul. 30, 1993

[51] Int. Cl.[5] ..... F02B 75/32

[52] U.S. Cl. ..... 123/63; 123/147.2

[58] Field of Search ..... 123/61 R, 63, 197.2

[56] References Cited

U.S. PATENT DOCUMENTS

| | | | |
|---|---|---|---|
| 682,003 | 9/1901 | Tuck et al. | 123/63 |
| 1,281,981 | 10/1918 | Krienitz | 123/63 |
| 4,485,769 | 12/1984 | Carson | 123/63 |
| 4,555,903 | 12/1985 | Heaton | 123/61 R |
| 4,658,768 | 4/1987 | Carson | 123/61 R |

FOREIGN PATENT DOCUMENTS

| | | | |
|---|---|---|---|
| 2608288 | 9/1977 | Fed. Rep. of Germany | 123/63 |
| 51-35645 | 4/1976 | Japan . | |

*Primary Examiner*—Tony M. Argenbright
*Assistant Examiner*—M. Macy
*Attorney, Agent, or Firm*—Robert W. J. Usher

[57] ABSTRACT

A double-acting piston engine has a crankshaft rotatable about a first central axis and having a crankpin having a second central axis which is spaced a distance from the first central axis, a cylinder assembly having a pair of cylinder chambers confronting each other along an axial line perpendicular to the first central axis, with the crankpin being disposed substantially between the cylinder chambers, and a piston assembly slidably disposed in the cylinder chambers and coupled to the crankpin. The piston assembly comprises a pair of pistons slidably fitted in the cylinder chambers, respectively, a joint disposed in the cylinder chambers and having opposite ends coupled to the pistons, respectively, the joint having a cylindrical opening defined therein, and a rotor rotatably fitted in the cylindrical opening for rotation about a third central axis, the rotor having an eccentric hole defined therein and spaced from the third central axis by a distance which is the same as the distance by which the second central axis is spaced from the first central axis, the crankpin being fitted in the eccentric hole thereby connecting the piston assembly to the crankpin.

4 Claims, 8 Drawing Sheets

DOUBLE-ACTING PISTON ENGINE

BACKGROUND OF THE INVENTION

1. Field of the Invention

The present invention relates to a double-acting piston engine having a pair of cylinders positioned on each side of a crankshaft and confronting each other and a pair of pistons slidably disposed in the respective cylinders and connected to each other.

2. Description of the Prior Art

One conventional double-acting piston engine is disclosed in Japanese patent publication No. 51-35645 or Japanese laid-open patent publication No. 49-63806. The disclosed double-acting piston engine comprises a joint interconnecting a pair of pistons and having an internal gear and a crankshaft having external pinions concentric with crankpins and held in mesh with the internal gear. Reciprocating movement of the pistons is transmitted through the internal gear and the external pinions to the crankshaft, thus rotating the crankshaft about its own axis.

The prior double-acting piston engine may be reduced in size and can produce large output power while causing reduced vibration.

However, if the double-acting piston engine is reduced in size, then the power transmitting mechanism that is composed of the internal gear and the external pinions for converting reciprocating movement of the pistons to rotary movement of the crankshaft is also reduced in size and hence mechanical strength.

The power transmitting mechanism is lubricated by lubricating oil which is supplied through lubricating holes defined from the crankshaft to the crankpins. The mechanical strength of the crankshaft tends to be reduced because of the lubricating holes.

SUMMARY OF THE INVENTION

It is therefore an object of the present invention to provide a double-acting piston engine which is compact and has sufficiently large mechanical strength.

Another object of the present invention is to provide a double-acting piston engine having a power transmitting mechanism for transmitting reciprocating movement of pistons to a crankshaft to rotate the crankshaft about its own axis, the power transmitting mechanism being compact and sufficiently strong.

Still another object of the present invention is to provide a double-acting piston engine including a crankshaft of high mechanical strength, the crankshaft having no lubricating holes for lubricating a power transmitting mechanism.

According to the present invention, there is provided a double-acting piston engine comprising a crankshaft rotatable about a first central axis and having a crankpin having a second central axis which is spaced a distance from the first central axis, a cylinder assembly having a pair of cylinder chambers confronting each other along an axial line perpendicular to the first central axis, with the crankpin being disposed substantially between the cylinder chambers, and a piston assembly slidably disposed in the cylinder chambers and coupled to the crankpin, the piston assembly comprising a pair of pistons slidably fitted in the cylinder chambers, respectively, a joint disposed in the cylinder chambers and having opposite ends coupled to the pistons, respectively, the joint having a cylindrical opening defined therein, and a rotor rotatably fitted in the cylindrical opening for rotation about a third central axis, the rotor having an eccentric hole defined therein and spaced from the third central axis by a distance which is the same as the distance by which the second central axis is spaced from the first central axis, the crankpin being fitted in the eccentric hole thereby connecting the piston assembly to the crankpin.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIGS. 6A, 6B through 10A, 10B are cross-sectional views showing the manner in which the double-acting piston engine operates;

DETAILED DESCRIPTION OF THE PREFERRED EMBODIMENT

Figure 1:
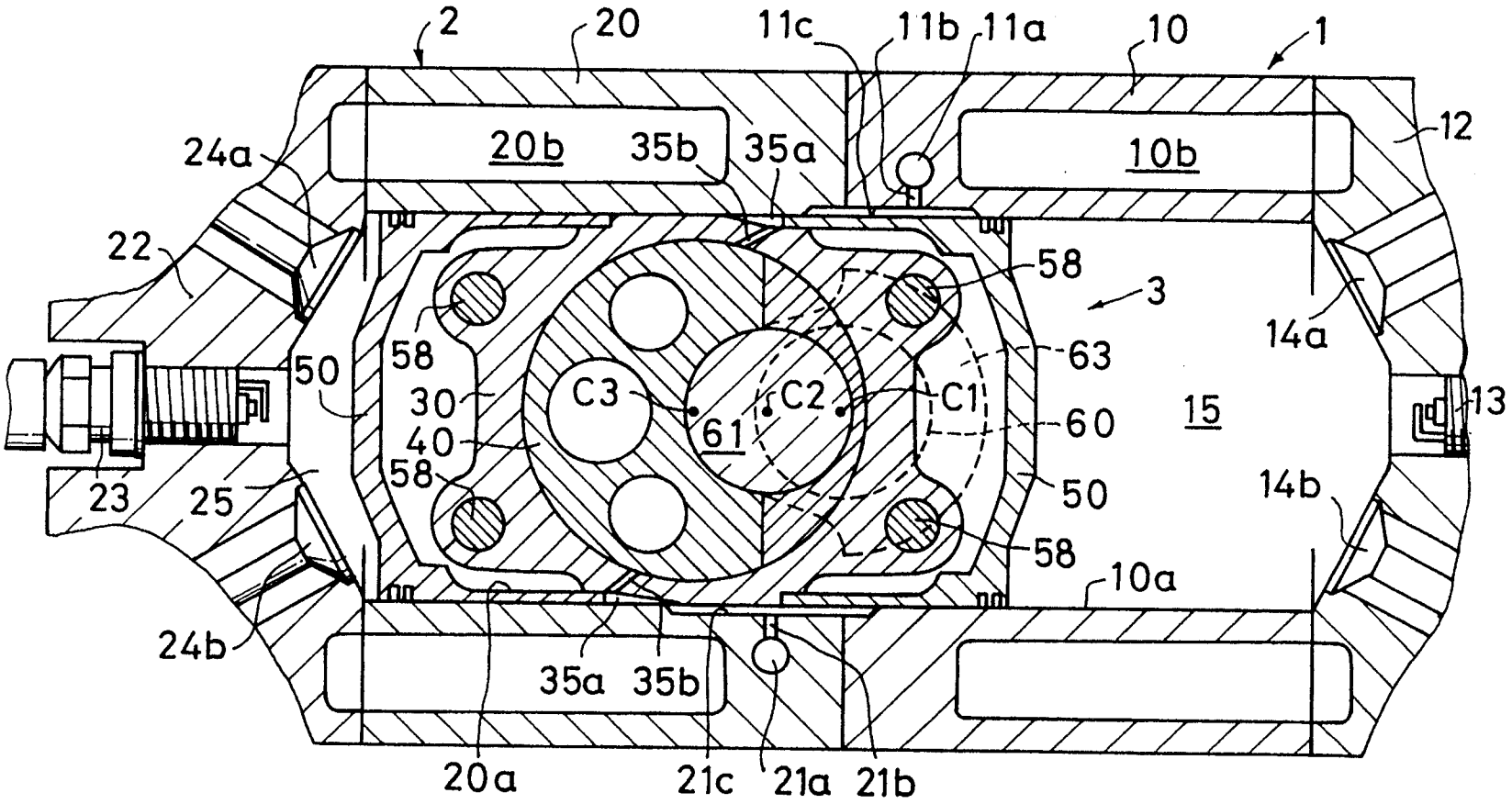
FIG. 1 is a fragmentary cross-sectional view of a double-acting piston engine according to the present invention.
Figure 2:
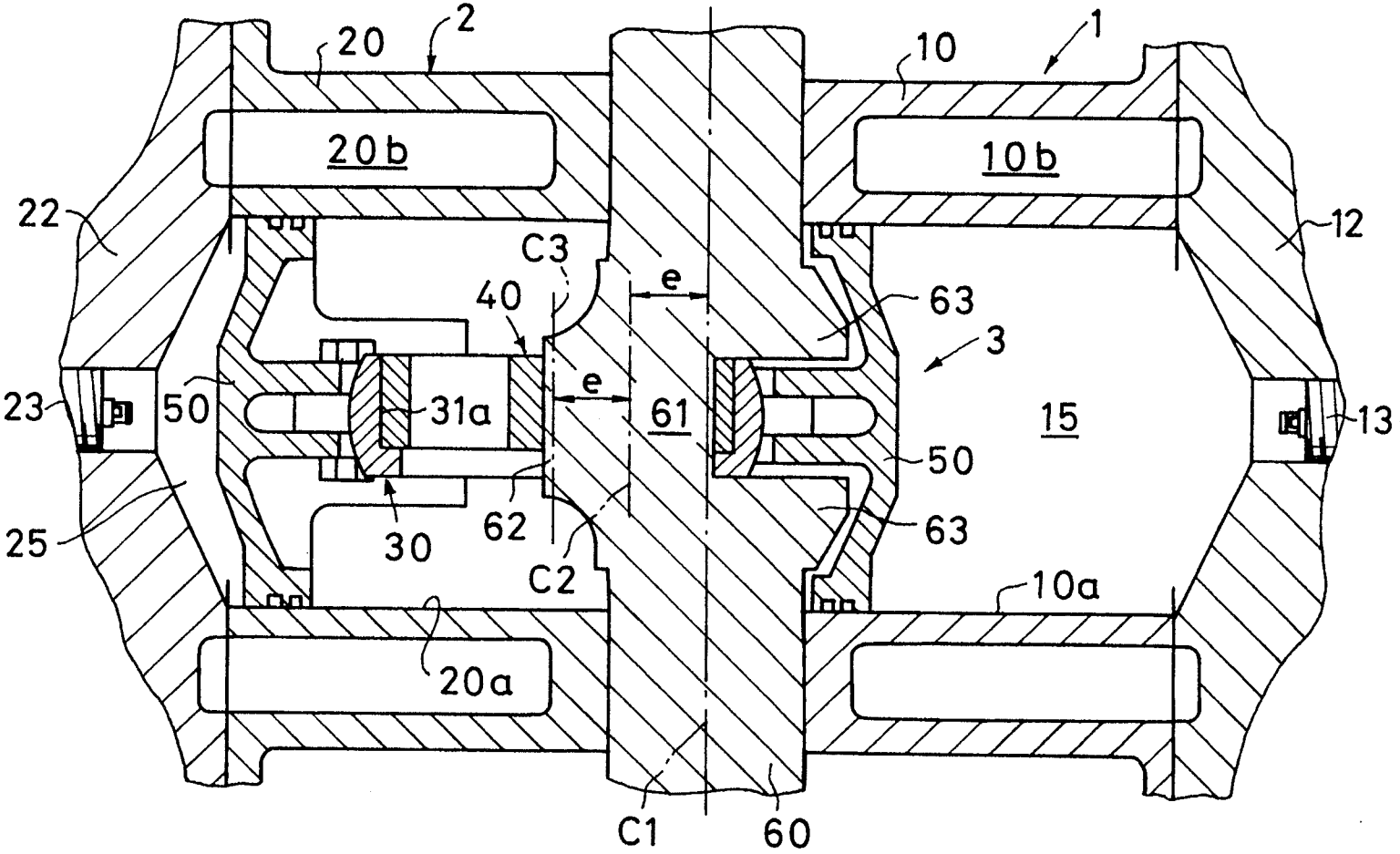
FIG. 2 is a fragmentary cross-sectional view of the double-acting piston engine.

As shown in FIGS. 1 and 2, a double-acting piston engine according to the present invention has a pair of cylinders 1, 2 confronting each other with a crankshaft 60 interposed therebetween. The cylinders 1, 2 comprise respective cylinder bodies 10, 20 having respective inner ends coupled to each other and respective cylinder heads 12, 22 mounted on respective outer ends of the cylinder bodies 10, 20. The cylinder heads 12, 22 support respective spark plugs 13, 23 and respective pairs of intake and exhaust valves 14*a*, 14*b*, 24*a*, 24*b*.

The cylinder bodies 10, 20 have respective cylinder bores 10*a*, 20*a* of the same diameter which are defined therein and extend perpendicularly to a central axis C1 (first central axis) of the crankshaft 60. The cylinder bores 10*a*, 20*a* are closed by the cylinder heads 12, 22, respectively, defining respective coaxial-cylinder chambers 15, 25 that face each other across the crankshaft 60. The cylinder bodies 10, 20 have coolant passages 10*b*, 20*b* defined respectively therein around the respective cylinder bores 10*a*, 20*a*. The cylinder bodies 10, 20 also have lubricating oil passages and grooves 11*a*~11*c*, 21*a*~21*c* described later on.

A piston assembly 3 is slidably fitted in the cylinder chambers 15, 25. The piston assembly 3 comprises a joint 30, a pair of pistons 50 fastened to respective opposite ends of the joint 30 by bolts 58, and a rotor 40 rotatably disposed in the joint 30. The pistons 50 are slidably fitted in the respective cylinder bores 10*a*, 20*a*, i.e., inserted in the respective cylinder chambers 15, 25. The pistons 50 integrally coupled to each other by the joint 30 are axially reciprocally movable in the respective cylinder chambers 15, 25.

Figure 3A:
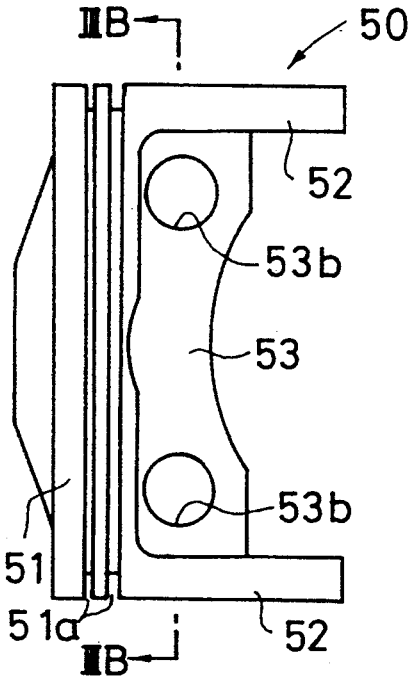
FIG. 3A is a front elevational view of a piston of the double-acting piston engine.
Figure 3B:
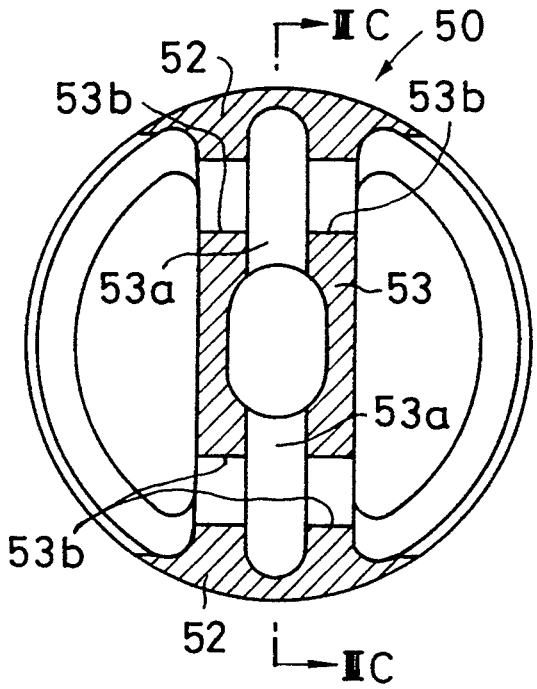
FIG. 3B is a cross-sectional view taken along line IIIB—IIIB of FIG. 3A.
Figure 3C:
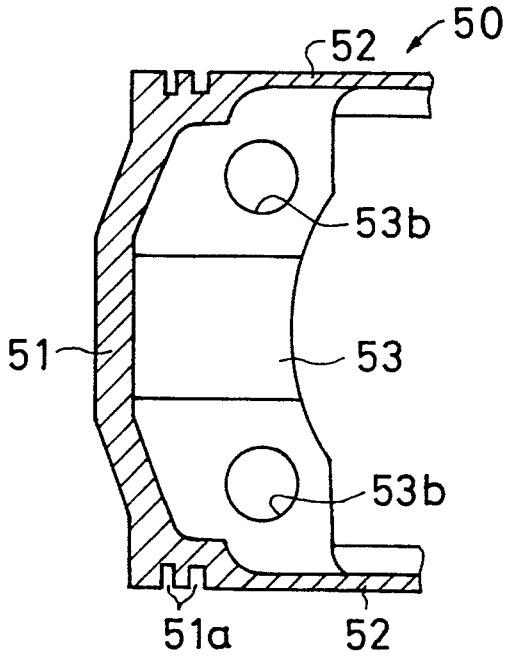
FIG. 3C is a cross-sectional view taken along line IIIC—IIIC of FIG. 3B.

The pistons 50 are identical in shape to each other. As shown in FIGS. 3A through 3C, each of the pistons 50 is of an integral unitary structure which comprises a cylindrical head 51 slidably fitted in one of the cylinder bores 10*a*, 10*b*, a pair of arcuate slippers 52 extending axially rearwardly (to the right in FIGS. 3A and 3C) from respective upper and lower sides of the head 51, and a rib 53 extending between and joining the slippers 52 behind the head 51. The head 51 has two ring grooves 51*a* defined in its outer circumferential surface, the ring grooves 51*a* serving to receiver a piston ring and an oil ring, respectively. The rib 53 has a vertically extending insertion groove 53*a* defined centrally therein, and a pair of upper and lower connecting holes 53*b* defined in vertically spaced positions and extending across the insertion groove 53*a*. The outer circumferential surface of the head 51 and the outer circumferential surfaces of the slippers 52 jointly serve as an outer cylindrical surface which is slidably held against the inner wall surface of one of the cylinder bores 10*a*, 20*a*.

Figure 4A:
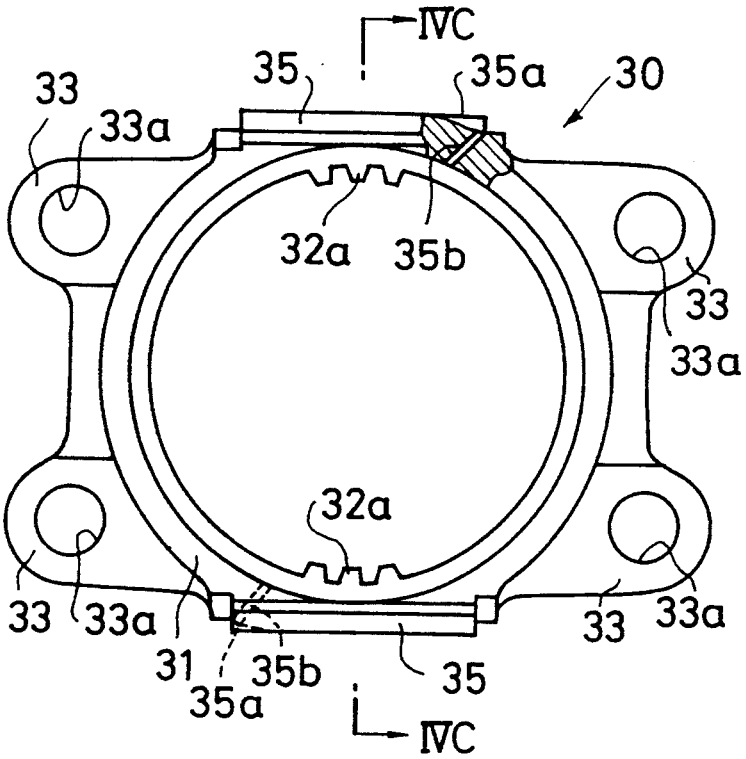
FIG. 4A is a front elevational view of a joint in the double-acting piston engine.
Figure 4B:
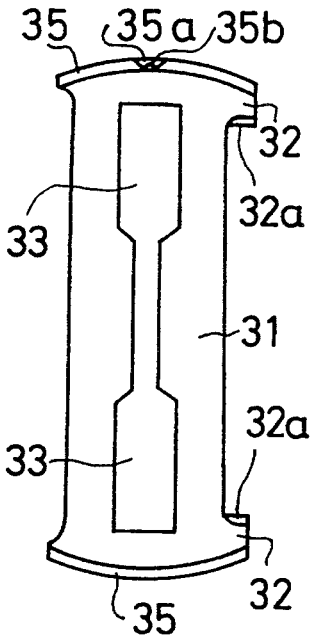
FIG. 4B is a side elevational view of the joint shown in FIG. 4A.
Figure 4C:
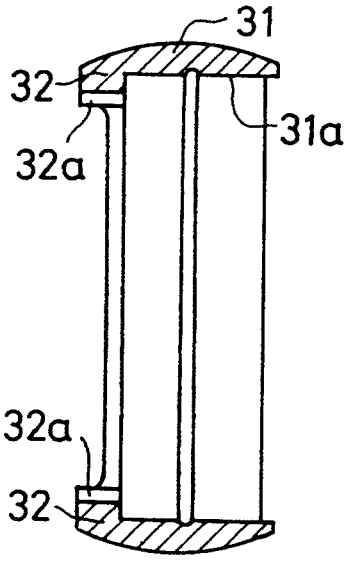
FIG. 4C is a cross-sectional view taken along line IVC—IVC of FIG. 4A.

As shown in FIGS. 4A through 4C, the joint 30 comprises a ring-shaped rim 31 and two pairs of upper and lower joint arms 33 extending laterally in opposite directions from the rim 31. The rim 31 has a cylindrical opening defined therein by an inner circumferential surface 31*a* and also has an integral shoulder 32 positioned transversely on one side of the inner circumferential surface 31*a* and projecting radially inwardly. Partial internal gears 32*a* each composed of three successive gear teeth are integrally formed with upper and lower diametrically opposite portions, respectively, of an inner circumferential surface of the shoulder 32. The joint arms 33 have respective connecting holes 33*a* defined transversely therein. The rim 31 has a pair of arcuate guides 35 disposed respectively on upper and lower portions of its outer circumferential surface and shaped complementarily to fit slidably in the cylinder bores 10*a*, 20*a*. Each of the guides 35 has a recess 35*a* defined in one end thereof and communicating with the inner circumferential surface 31*a* of the rim 31 through a first lubricating hole 35*b* that is defined in the rim 31.

The joint arms 33 are inserted in the insertion grooves 53*a* in the ribs 53 of the pistons 50, and the pistons 50 are fastened to the opposite sides of the joint 30 by the bolts 58 inserted through the connecting holes 33*a*, 53*b*, as shown in FIGS. 1 and 2. With the pistons 50 fastened to the joint 30, the slippers 52 are held against the guides 35 of the joint 30, and the outer circumferential surfaces of the piston heads 51, the slippers 52, and the guides 95 are lined up on the same circumferential plane, and slidably fitted in the cylinder bores 10*a*, 20*a*, as shown in FIGS. 1 and 2.

Figure 5:
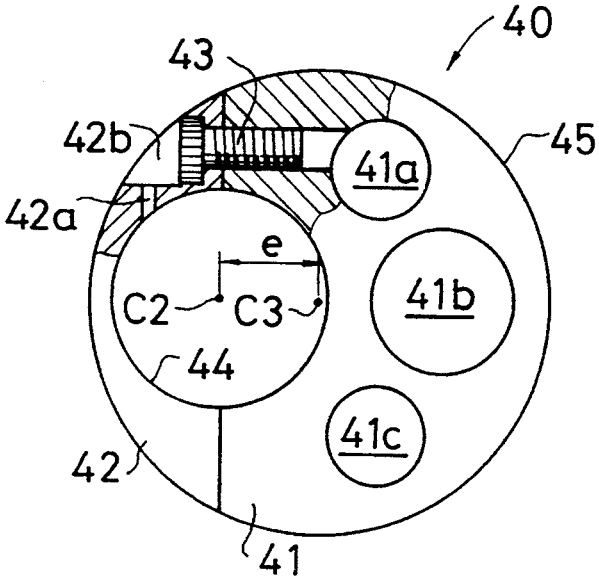
FIG. 5 is a front elevational view, partly broken away, of a rotor in the double-acting piston engine.

As shown in FIG. 5, the rotor 40 comprises a first rotor member 41 and a second rotor member 42 which are fastened to each other by a bolt 43, and has an outer cylindrical surface 45. The first and second rotor members 41, 42 have respective flat mating surfaces that are held against each other. The rotor 40 has an eccentric hole 44 defined therein which has a central axis C2 (second central axis) that is spaced a distance e from a central axis C3 (third central axis) of the outer cylindrical surface 45. The second central axis C2 is positioned in alignment with the flat mating surfaces of the first and second rotor members 41, 42. The first rotor member 41 has holes 41*a*, 41*b*, 41*c* defined therein to reduce the weight thereof. The second rotor member 42 has a recess 42*b* defined therein which receives the head of the bolt 43. The second rotor member 42 also has a small second lubricating hole 42*a* extending from the recess 42*b* to the eccentric hole 44.

The outer circumferential surface 45 of the rotor 40 is of such dimensions that it is rotatably fitted in the inner circumferential surface 31*a* of the rim 31 of the joint 30. The eccentric hole 44 is of such dimensions that a crankpin 61 of the crankshaft 60 is rotatably fitted therein. As shown in FIGS. 1 and 2, the rotor 40 is mounted on the crankpin 61 that is rotatably fitted in the eccentric hole 44, and is rotatably fitted in the rim 31 of the joint 30 which is slidably fitted in the cylinder bores 10*a*, 2O*a*, i.e., inserted in the cylinder chambers 15, 25. As a result, the piston assembly 3 is coupled to the crankpin 61, and disposed in the cylinder chambers 15, 25 for axial movement therein.

The crankshaft 60 is supported by the cylinder bodies 10, 20 for rotation about the first central axis C1. The second central axis C2 of the crankpin 61 is spaced a distance e from the first central axis C1 of the crankshaft 60. The crankpin 61 has a partial external gear 62 on one side thereof which is positioned most remotely from the first central axis C1, the partial external gear 62 having three tooth bottoms. The distance e between the first and second central axes C1, C2 is equal to the distance e between the second and third central axes C2, C3. The crankshaft 60 has a pair of counterbalances 83 integral therewith which is positioned diametrically opposite to the crankpin 61 across the first central axis C1.

Operation of the double-acting piston engine will be described below with reference to FIGS. 6A, 6B through 10A, 10B. It is assumed that the crankshaft 60 rotates clockwise about its own axis.

Figure 6B:
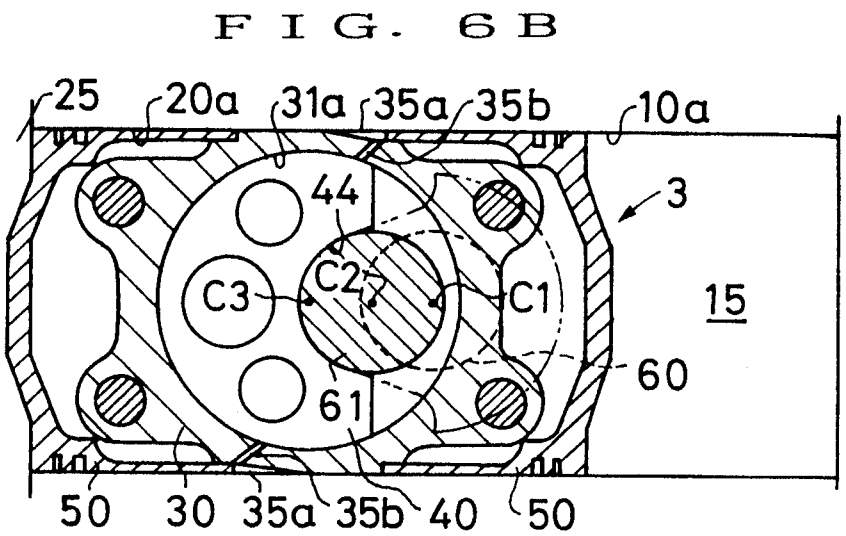
Figure 6A:
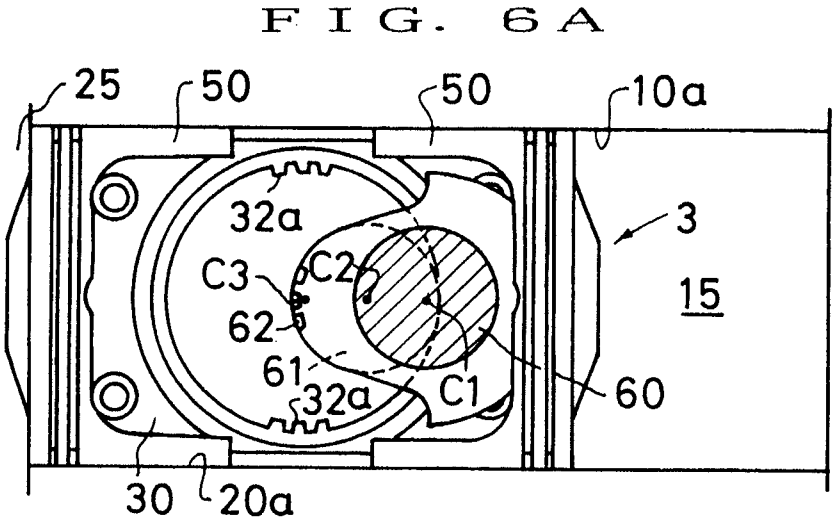

In FIGS. 6A and 6B, the piston assembly 3 is in the leftmost position in the cylinder bores 10*a*, 20*a*. In this position, the first central axis C1 of the crankshaft 60, the second central axis C2 of the crankpin 61, and the third central axis C3 about which the rotor 40 rotates with respect to the joint 30 are lined up horizontally. The second central axis C2 is spaced leftward from the first central axis C1 by the distance e, and the third central axis C3 is spaced leftward from the second central axis C2. The left-hand piston 50 is in its top dead center with the left-hand cylinder chamber 25 having the smallest volume, i.e., being most compressed, and the right-hand piston 50 is in its bottom dead center with the right-hand cylinder chamber 15 having the largest volume, i.e., being most expanded.

Figure 7B:
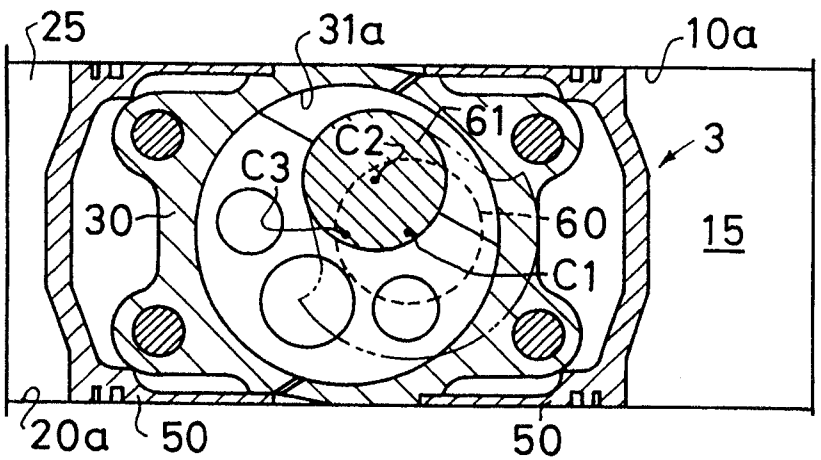
Figure 7A:
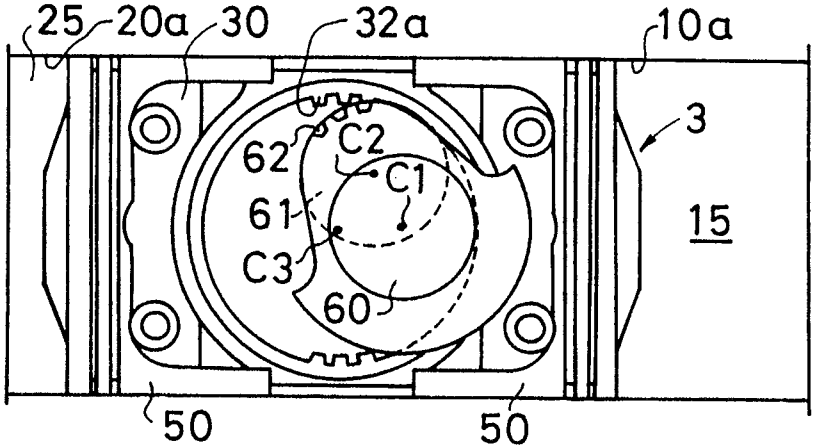

When the crankshaft 60 rotates 60° clockwise from the position shown in FIGS. 6A and 6B, the parts of the double-acting piston engine are brought into the position shown in FIGS. 7A and 7B. Upon such clockwise rotation of the crankshaft 60, the second central axis C2 rotates 60° clockwise about the first central axis C1. Since the crankpin 61 is slidably fitted in the eccentric hole 44 of the rotor 40, the rotor 40 moves rightward with the joint 30 while rotating in the inner circumferential surface 31*a* of the joint 30. The third central axis C3 also moves to the right. Therefore, the piston assembly 3 slides rightward in the cylinder bores 10*a*, 20*a*, with the left-hand cylinder chamber 25 expanded and the right-hand cylinder chamber 15 compressed. Thus, in terms of a four-stroke cycle engine, the left-hand piston 50 starts a power or intake stroke, and the right-hand piston 50 starts a compression or exhaust stroke.

When the rotor 40 rotates 60° in the inner circumferential surface 31*a* of the joint 30, the upper partial internal gear 32*a* of the joint 30 starts meshing with the partial external gear 62 of the crankpin 61.

Figure 8B:
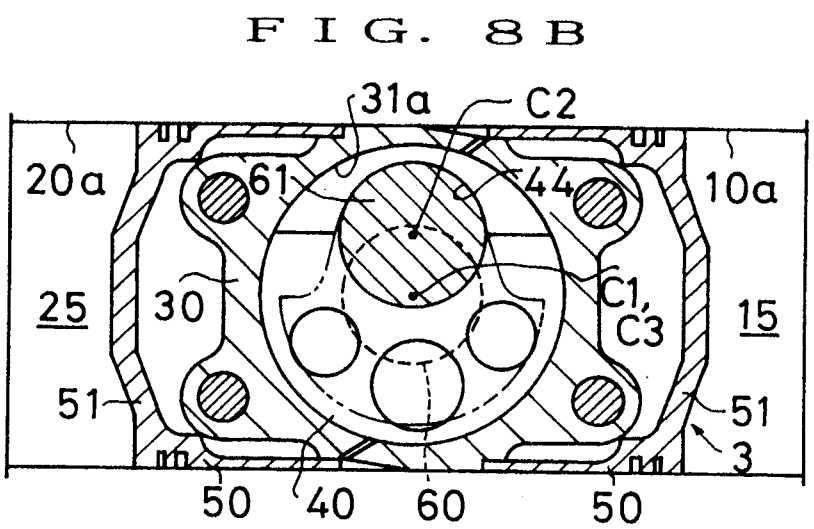
Figure 8A:
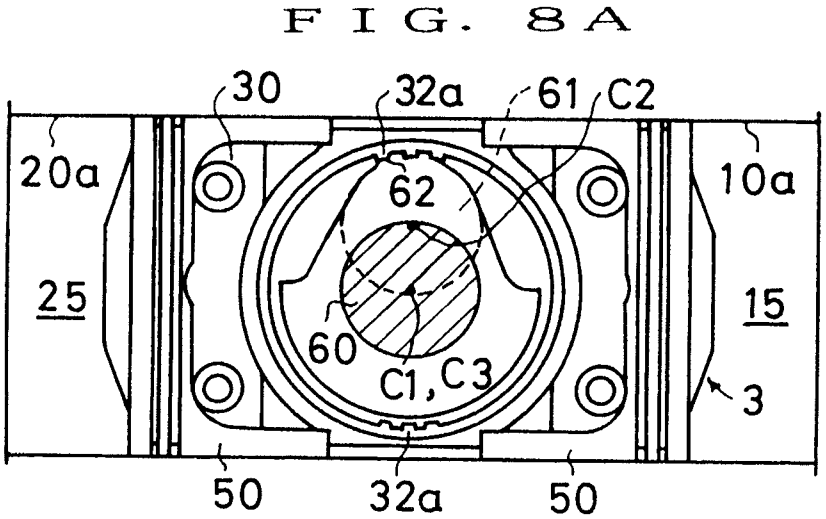

FIGS. 8A and 8B show the position of the parts of the double-acting piston engine when the crankshaft 60 has rotated 30° from the position shown in FIGS. 7A and 7B, i.e., 90° from the position shown in FIGS. 6A and 6B. In the position shown in FIGS. 8A and 8B, the second central axis C2 is positioned directly above the first central axis C1, and the first and third central axes C1, C3 are aligned with each other.

When the first and third central axes C1, C3 are aligned with each other, if the gears 32*a*, 62 did not exist, then rotation of the crankshaft 60 would cause the rotor 40 to rotate about the axes C1, C3 within the inner circumferential surface 31*a* in unison with the crankshaft 61, and the joint 30 and hence the piston assembly 3 would not move axially. Even when the crankshaft 60 is rotated by a starter motor or the like, therefore, the piston assembly 3 would not move, failing to start the double-acting piston engine. In the illustrated embodiment, however, since the partial internal gear 32*a* of the joint 30 and the partial external gear 62 of the crankpin 61 are held in mesh with each other at this time, the piston assembly 3 can be axially moved when the crankshaft 60 is rotated.

The meshing gears 32*a*, 62 are thus effective in preventing the rotor 40 and the crankshaft 61 from rotating idly together. However, once the double-acting piston engine is started and rotates at a certain speed of 10 rpm, for example, the parts move past the position shown in FIGS. 8A and 8B due to the inertia of the rotor 40, and the rotor 40 and the crankshaft 61 do not rotate idly together. Therefore, the gears 32*a*, 62 are not necessary insofar as the double-acting piston engine operates in a normal speed range higher than an idling speed of about 600 rpm, for example. In this embodiment, the gears 32*a*, 62 have relatively large backlash such that when the double-acting piston engine operates in a normal speed range, the gears 32*a*, 62 are kept out of contact with each other and do not produce noise.

In order to bring the gears 32*a*, 62 into mesh with each other when the crankshaft 60 has rotated 90° from the position shown in FIGS. 6A and 6B, the pitch diameter of the partial internal gear 32*a* is set to twice the pitch diameter of the partial external gear 62.

Instead of the partial gears 32*a*, 62, the crankpin 61 may have an external gear on its entire outer circumferential surface and the joint 30 may have an internal gear on its entire inner circumferential surface. With such an alternative, however, tile crankshaft 61 has a reduced mechanical strength and is relatively expensive to manufacture.

Figure 9B:
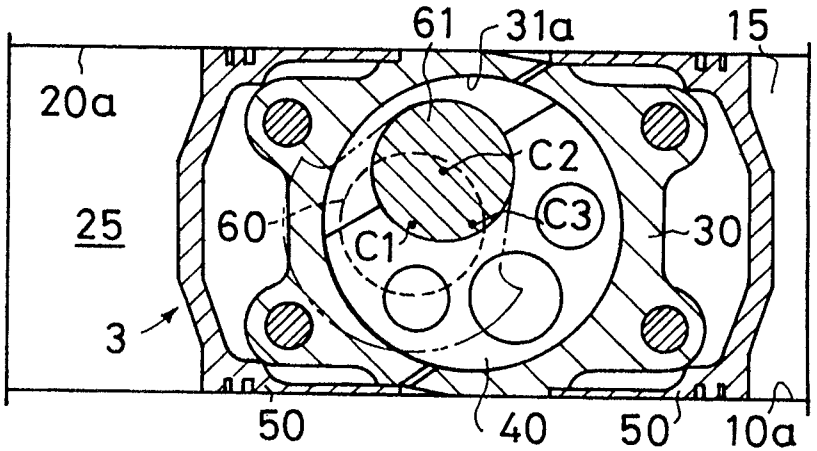
Figure 9A:
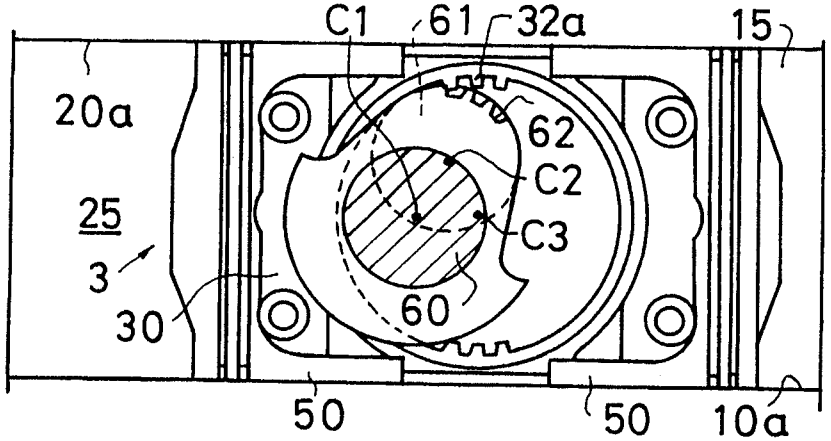

FIGS. 9A and 9B show the position of the parts of the double-acting piston engine when the crankshaft 60 has further rotated 30° from the position shown in FIGS. 8A and 8B. Upon rotation of the crankpin 61 about the first central axis C1, the meshing engagement of the gears 32*a*, 62 causes the piston assembly 3 to move rightward in the cylinder bores 10*a*, 20*a*, and hence the third central axis C3 moves to the right. Though the gears 32*a*, 62 start to move out of mesh with each other, the rotor 40 does not rotate with the crankshaft 60 because the central axes C1, C2, C3 are spaced from each other.

Figure 10B:
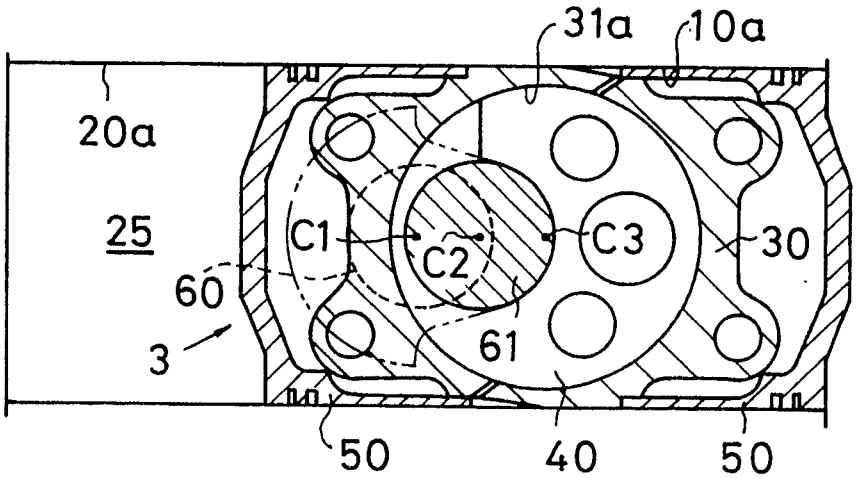
Figure 10A:
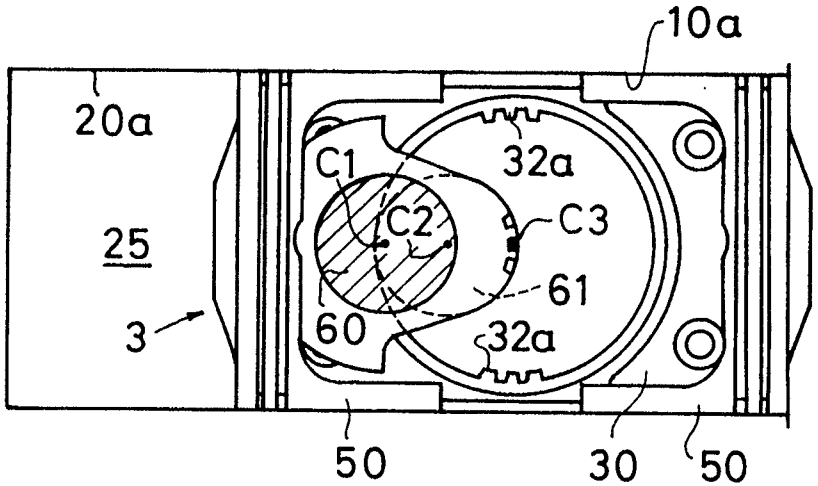

When the crankshaft 60 further rotates 60° from the position shown in FIGS. 9A and 9B, i.e., 180° from the position shown in FIGS. 6A and 6B, the parts of the double-acting piston engine are positioned as shown in FIGS. 10A and 10B. At this time, the piston assembly 3 is in the rightmost position in the cylinder bores 10*a*, 20*a*, and the first central axis C1, the second central axis C2, and the third central axis C3 are lined up horizontally. The left-hand piston 50 is in its bottom dead center with the left-hand cylinder chamber 25 having the largest volume, i.e., being most expanded, and the right-hand piston 50 is in its top dead center with the right-hand cylinder chamber 15 having the smallest volume, i.e., being most compressed.

In FIGS. 6A, 6B through 10A, 10B, the crankshaft 60 rotates 180° and the piston assembly 3 moves from the leftmost position to the rightmost position. Continued rotation of the crankshaft 60 through 180° then moves the piston assembly 3 from the rightmost position back to the leftmost position, thus completing one cycle of reciprocating movement of the piston assembly 3. Therefore, when the crankshaft 60 makes two rotations, the piston assembly 3 reciprocates in two cycles, making two reciprocating movements. When the spark plugs 13, 23 are ignited and the intake and exhaust valves 14*a*, 14*b*, 24*a*, 24*b* are opened and closed in synchronism with the rotation of the crankshaft 60, the double-acting piston engine can operate as a four-stroke cycle piston engine with the pistons 50 moving in intake, compression, power, and exhaust strokes in the respective cylinder chambers 15, 25.

While the double-acting piston engine is in operation, the inner circumferential surface 31*a* of the joint 30 and the outer circumferential surface 45 of the rotor 40 which are held in sliding contact with each other, and the inner circumferential surface of the eccentric hole 44 and the outer circumferential surface of the crankpin 61 which are also held in contact with each other, should properly be lubricated for smooth relative movement of these components. Heretofore, it has been customary to introduce lubricating oil to these mating surfaces from lubricating holes defined from the crankshaft to the crankpin. However, since the conventional lubricating holes reduce the mechanical strength of the crankshaft and the crankpin, the crankshaft and the crankpin have to be relatively large in diameter, and the overall engine size is relatively large.

According to the present invention, as shown in FIG. 1, the cylinder bodies 10, 20 have upper and lower lubricating oil passages 11*a*, 21*a*, upper and lower lubricating oil passages 11*b*, 21*b*, and upper and lower lubricating oil grooves 11*c*, 21*c* defined therein and extending axially with respect to the cylinder chambers 15, 25 for supplying lubricating oil from an external source. More specifically, the upper and lower lubricating oil passages 11*a*, 21*a* are defined in the cylinder bodies 10, 20, respectively, and the upper and lower lubricating oil passages 11*b*, 21*b* are defined in the cylinder bodies 10, 20, respectively, in communication with the upper and lower lubricating oil passages 11*a*, 21*a*, respectively. The upper and lower lubricating oil grooves 11*c*, 21*c* are defined in the inner circumferential surfaces of the cylinder bores 10*a*, 20*a* in communication with the upper and lower lubricating oil passages 11*b*, 21*b*. The lubricating oil is supplied from the external source to the lubricating oil passages 11a, 21a, from which it is supplied through the lubricating oil passages 11b, 21b to the upper and lower lubricating oil grooves 11c, 21c. The upper lubricating oil groove 11c is positioned mainly in the cylinder bore 10a, but has an end portion extending into the cylinder bore 20a, i.e., the upper lubricating oil groove 11c has its major portion located on the right-hand side of the mating surfaces of the cylinder bodies 10, 20. The lower lubricating oil groove 21c is positioned mainly in the cylinder bore 20a, but has an end portion extending into the cylinder bore 10a, i.e., the lower lubricating oil groove 21c has its major portion located on the left-hand side of the mating surfaces of the cylinder bodies 10, 20. The upper and lower lubricating oil grooves 11c, 21c open into the cylinder bores 10a, 20a. The recess 35a of the upper guide 35 of the joint 30 is positioned such that it can communicate with the upper lubricating oil groove 11c, and the recess 35a of the lower guide 35 of the joint 30 is positioned such that it can communicate with the lower lubricating oil groove 11c.

During operation of the double-acting piston engine, the piston assembly 3 reciprocates in the cylinder bores 10a, 20a as described above. When the piston assembly 3 moves to the leftmost position as shown in FIG. 1, the lower lubricating oil groove 21c communicates with the recess 35a of the lower guide 35. When the piston assembly 3 is positioned intermediate between the leftmost and rightmost positions, the lower lubricating oil groove 21c remains to communicate with the recess 35a of the lower guide 35, and the upper lubricating oil groove 11c communicates with the recess 35a of the upper guide 35. When the piston assembly 3 moves to the rightmost position, the upper lubricating oil groove 11c communicates with the recess 35a of the upper guide 35. Accordingly, at least one of the recesses 35a is supplied with lubricating oil through the upper lubricating oil groove 11c, or the lower lubricating oil groove 21c, or both at all times while the piston assembly 3 is reciprocating in the cylinder bores 10a, 20a.

Since the recesses 35a communicate with the inner circumferential surface 31a of the rim 31 through the first lubricating holes 35b, lubricating oil is always supplied to the inner circumferential surface 31a of the rim 31 and the outer circumferential surface 45 of the rotor 40 which slidingly mate with each other. The recess 42b defined in the second rotor member 42 of the rotor 40 opens at the outer circumferential surface 45 of the rotor 40, and the second lubricating hole 42a extends from the recess 42b to the eccentric hole 44. Therefore, the lubricating oil that has been supplied to the inner circumferential surface 31a of the rim 31 and the outer circumferential surface 45 of the rotor 40 is supplied through the second lubricating hole 42b to the inner circumferential surface of the eccentric hole 40 and the outer circumferential surface of the crankpin 61 which slidingly mate with each other.

Inasmuch as lubricating oil is supplied from the cylinders 1, 2 to the various slidingly mating surfaces, it is not necessary for the crankshaft 60 and tile crankpin 61 to have any lubricating holes. Thus, the crankshaft 60 and the crankpin 61 are of relatively large mechanical strength.

Figure 11:
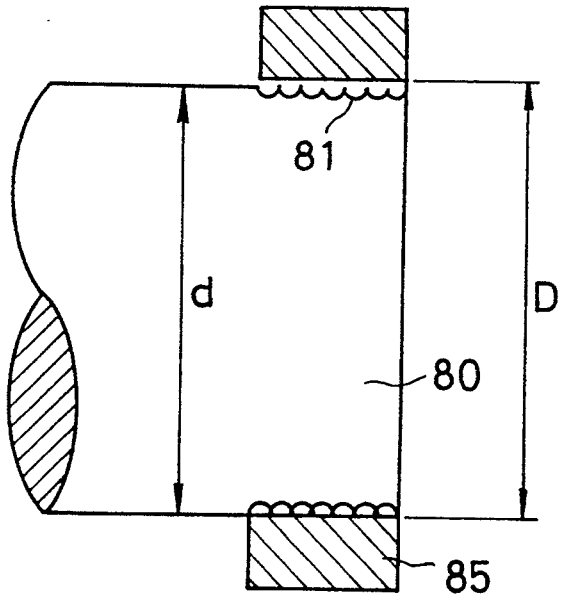
FIG. 11 is a view of an oil bearing structure applicable to the double-acting piston engine.
Figure 12:
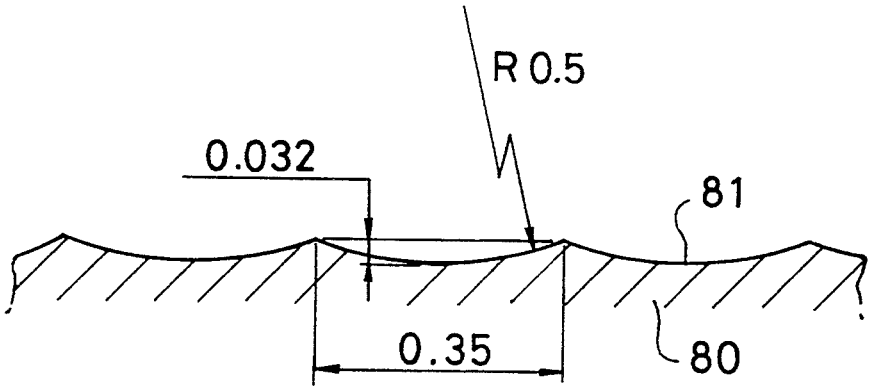
FIG. 12 is an enlarged fragmentary cross-sectional view of an oil bit in the oil bearing structure shown in FIG. 11.

The double-acting piston engine according to the present invention employs oil bearings, rather than conventional bearings such as ball bearings, roller bearings, or journal bearings, for supporting rotatable components including the rotor 40, the crankshaft 60, the crankpin 61, etc. More specifically, as shown in FIG. 11, each of the oil bearings comprises an oil bit 81 disposed on a surface of a rotatable shaft 80 which is held in sliding contact with a surface of a support member 85. As shown in FIG. 12, the oil bit 81 comprises parallel grooves for retaining an oil layer, each having a width of 0.35 mm and a depth of about 0.032 mm. The grooves of the oil bit 81 may be formed by lathing the shaft 80 with a cutter having a cutting tip radius of 0.5 mm.

The oil bearing in the form of the oil bit 81 allows the slidingly mating surfaces to be held closely to each other with a small clearance, i.e., a small difference between the inside diameter D of the support member 85 and the diameter d of the shaft 80. The oil bearing also permits the shaft 80 to rotate smoothly and quietly without much wear as the shaft 80 is rotatably supported by an oil layer retained in the oil bit 81.

Either the shaft 80 or the support member 85 is made of a harder material such as steel and the other of a softer material such as an aluminum alloy. The oil bit 81 is formed on the softer material. While the depth of the oil bit 81 is about 30 μm, the clearance between the slidingly mating surfaces of the shaft 80 and the support member 85 should preferably in the range from 5 μm to 20 μm. When the double-acting piston engine is broken in, the crests of the ridges of the oil bit 81 are ground by 2 μm to 3 μm. After the break-in, the ridges of the oil bit 81 are not worn, allowing the double-acting piston engine to operate smoothly.

Although a certain preferred embodiment of the present invention has been shown and described in detail, it should be understood that various changes and modifications may be made therein without departing from the scope of the appended claims.

What is claimed is:

1. A double-acting piston engine comprising:

a crankshaft rotatable about a first central axis and having a crankpin having a second central axis which is spaced a distance from said first central axis;

a cylinder assembly having a pair of cylinder chambers confronting each other along an axial line perpendicular to said first central axis, with said crankpin being disposed substantially between said cylinder chambers; and a piston assembly slidably disposed in said cylinder chambers and coupled to said crankpin;

said piston assembly comprising:

a pair of pistons slidably fitted in said cylinder chambers, respectively;

a joint disposed in said cylinder chambers and having opposite ends coupled to said pistons, respectively, said joint having a cylindrical opening defined therein; and a rotor rotatably fitted in said cylindrical opening for rotation about a third central axis, said rotor having an eccentric hole defined therein and spaced from said third central axis by a distance which is the same as said distance by which said second central axis is spaced from said first central axis, said crankpin being fitted in said eccentric hole thereby connecting said piston assembly to said crankpin.

2. A double-acting piston engine according to claim 1, wherein said joint has a pair of partial internal gears which are positioned diametrically opposite to each other across said third central axis, said crankpin having on one side thereof a partial external gear positioned for mesh with said partial internal gears, the arrangement being such that when said crankshaft rotates about said first central axis to position said second central axis near a plane which is perpendicular to said axial line and passes through said first central axis, said partial external gear meshes with one of said partial internal gears.

3. A double-acting piston engine according to claim 1, wherein said joint has a guide positioned between said pistons and held in sliding contact with an inner circumferential surface of said cylinder chambers, said inner circumferential surface having a lubricating oil groove extending axially with respect to said cylinder chambers, said joint having a first lubricating hole communicating between a surface of said guide which faces said lubricating oil groove and an inner circumferential surface of said cylindrical opening, the arrangement being such that lubricating oil supplied from outside of said cylinder assembly to said lubricating oil groove is supplied through said lubricating hole to an outer circumferential surface of said rotor which is held in sliding contact with said inner circumferential surface of said cylindrical opening.

4. A double-acting piston engine according to claim 3, wherein said rotor has a second lubricating hole communicating between said outer circumferential surface of said rotor and an inner circumferential surface of said eccentric hole, the arrangement being such that the lubricating oil supplied to the outer circumferential surface of said rotor is supplied through said second lubricating hole to an outer circumferential surface of said crankpin which is held in sliding contact with the inner circumferential surface of said eccentric hole.

* * * * *